US005377904A

United States Patent [19]

Michlin et al.

[11] Patent Number: 5,377,904

[45] Date of Patent: Jan. 3, 1995

[54] ONE PIECE MAILER FORM AND METHOD OF PROCESSING

[75] Inventors: Irving R. Michlin, Katonah, N.Y.; Jerome B. Schwartz, Danbury, Conn.

[73] Assignee: Transkrit Corporation, Roanoke, Va.

[21] Appl. No.: 125,494

[22] Filed: Sep. 22, 1993

Related U.S. Application Data

[63] Continuation of Ser. No. 856,577, Mar. 24, 1992, abandoned.

[51] Int. Cl.[6] ..... B65D 27/00

[52] U.S. Cl. ..... 229/70

[58] Field of Search ..... 229/70

[56] References Cited

U.S. PATENT DOCUMENTS

| | | | |
|---|---|---|---|
| 332,454 | 12/1885 | Smith | 229/70 |
| 1,127,886 | 4/1916 | Newcomb | 229/70 |
| 2,152,135 | 3/1939 | Case et al. | 229/92.1 |
| 2,835,434 | 5/1958 | Watson | 229/70 |
| 3,270,949 | 9/1966 | Hillman | 229/92.1 |
| 3,356,286 | 12/1967 | Greason | 229/70 |
| 3,467,299 | 9/1969 | Meyer | 229/70 |
| 4,668,211 | 5/1987 | Lubotto et al. | 493/188 |
| 4,706,878 | 11/1987 | Lubotto et al. | 229/73 |
| 4,784,317 | 11/1988 | Chen et al. | 229/70 |
| 4,809,905 | 3/1989 | Goodman | 229/70 |
| 4,915,287 | 4/1990 | Volk et al. | 229/70 |
| 5,048,748 | 9/1991 | Martin et al. | 229/92.1 |

FOREIGN PATENT DOCUMENTS 0814428.3 11/1988 Germany .

*Primary Examiner*—Stephen P. Garbe
*Attorney, Agent, or Firm*—Francis C. Hand

[57] ABSTRACT

The mailer form has an envelope portion integrated with a letterhead or insert portion to permit feeding through an imaging device such as a laser printer whereby both the letterhead portion and the envelope portion can be imaged at the same time. The letterhead or insert portion can be imaged with information turned 90° relative to the addressee block on the envelope portion. The insert portion may also be laminated to provide a greeting card effect.

22 Claims, 2 Drawing Sheets

ONE PIECE MAILER FORM AND METHOD OF PROCESSING

This is a continuation-in-part of application Ser. No. 07/856,577 filed on Mar. 24, 1992, now abandoned.

This invention relates to a one piece mailer form and to a method of processing a one piece mailer form.

As is known, various types of mailer constructions have been made for return mail purposes and for direct mail purposes.

For example, in the case of return mail constructions, multi-ply forms have been used which serve not only to mail the entire form to an addressee but also to provide a return mail envelope for the addressee to return information to the original sender.

Return mailers have also been known, for example, from U.S. Pat. Nos. 4,668,211 and 4,706,878 which can be prepared for use in laser electronic printers. In such cases, a mailer blank has been formed with an outgoing envelope portion and various panels which can be folded over to form a mailer as well as a return mailer envelope. Such mailers have been constructed so that the forms can be fed through a laser printer to receive imaging.

It has also been known from U.S. Pat. No. 2, 152,135 to construct a single sheet of letter sized paper so that the sheet may be folded and used for a mailing envelope. Still other constructions have been known, for example from U.S. Pat. No. 3,270,949, which provide a single sheet of paper which can be provided with printed information and which can be folded into a mailing piece and mailed in an envelope and subsequently unfolded and refolded to form a return mailer.

It is also been known from U.S. Pat. No. 4,951,864 to provide a one piece mailer which can be fed through a laser printer so as to be provided with variable information, such as address information, and thereafter folded for mailing purposes.

Mailer constructions have also been known which are made up in a continuous form assembly wherein each section of the assembly provides a form constituted by an envelope and a contiguous insert portion which can be separated from the envelope portion and subsequently inserted into the envelope for mailing purposes. In such cases, the envelope has been preprinted with return addressee information while the insert portion has been pre-printed with other information. However, such forms are not personalized, for example by feeding through a laser printer and provided with information regarding an individual outgoing addressee.

It has also been known that form letters, or personalized letters, can be readily processed and imaged in laser printers and the like using personal computers. It is also known that, in order to address an envelope for such a letter, the envelope had to be inserted in a typewriter or inserted separately into a printer such as a dot matrix printer. Thus, where multiple letters are imaged with personalized information and separate multiple envelopes are addressed in a typewriter or otherwise, there is a risk that the correct letter would not be stuffed in the correct envelope.

Accordingly, it is an object of the invention to provide a one piece mailer form forming an envelope portion and a letterhead or insert portion which can be personalized with respect to an outgoing addressee.

It is another object of the invention to provide a one piece mailer form which can be fed through a laser printer or the like and customized to an addressee.

It is also another object of the invention to provide a mailer form which permits imaging of a letter and addressing of an envelope in one pass through all imaging machine, such as a printer.

Briefly, the invention provides a one piece mailer form comprised of an envelope portion and a second separable portion which may form either a letterhead portion or an insert portion.

The envelope portion is constructed of a pair of parts which are disposed over each other and which are secured to each other in order to define an open pocket therebetween. In this respect, the two parts may be formed of a single sheet which is folded over to form the pocket or by two separate sheets which are secured to each other to form the pocket. In addition, the envelope portion includes a flap portion which extends from one of the two parts for folding over the other of the parts in order to close the pocket. A suitable adhesive is also provided on the flap portion for sealing purposes.

In one embodiment, the flap part extends from a part of the envelope portion which is to form the front of the envelope portion for receiving addressee information. In this embodiment, the adhesive is exposed. In such cases, the adhesive is of a type which is heat resistant and which provides lay flat characteristics, such as described in U.S. Pat. No. 4,951,864, in order to be fed through a laser printer in an exposed manner without detrimental effect on the adhesive and, more particularly, the printer. In another embodiment, the flap portion may extend from one part in facing relation to the second part so as to be protected against the heat generated in a laser printer. In this case, any suitable type of adhesive may be used for securing purposes. That is, there may be no need to have a heat resistant adhesive on the flap portion.

The second portion of the mailer which extends from the envelope portion may be in the form of a blank letterhead to receive printed information thereon. In one embodiment, one side of this letterhead portion may be provided with a preprinted logo, pre-printed sender information and the like. When the mailer is fed through a laser printer or other imaging means such as an ink jet printer, impact printer or other printing technology imaged information can be placed on the letterhead portion in a position rotated 90° relative to the envelope portion via a template, macro or the like in a word processor. In addition, the envelope portion is imaged by the printer with addressee information simultaneously in the same operation without need for a separate typewriter or a second pass through the imaging meads.

The mailer is also provided with a line of weakening or the like between the two portions in order to permit separation of the two portions from each other. When separated, the second or letterhead portion can be folded and placed within the pocket of the envelope portion and mailed.

In another embodiment, one of the two parts forming the envelope portion may be provided with a pair of tab portions which are folded over along opposite sides of the part and secured to the other envelope part in order to define an open pocket.

In the embodiment where the second part of the mailer forms an insert portion, the insert portion may be provided with a fold line extending perpendicular to the envelope portion. This insert portion may also have a tear-off portion extending from the envelope portion in parallel to the remainder of the insert portion with a line of weakening therebetween. In this embodiment, the insert portion can be separated from the envelope portion, the tear off portion removed and the remaining insert portion folded over and placed in the envelope portion. Such an insert may also be provided with preprinted information. Further, during travel through a printer, such as a laser printer, the mailer form can be customized, for example, such that common addressee information can be printed not only on the envelope portion but also on the insert portion. Thus, the foldable insert portion may be preprinted to convey a common message to an outgoing addressee. Also, this foldable insert portion may be laminated of multiple plies to have a greater weight than the envelope portion and to thus function for example as a greeting card.

The invention also provides a method of making a one piece mailer form. In this respect the method includes the steps of obtaining a single ply of paper having a pair of adhesive strips along opposite sides of at least one part of two contiguous parts of a ply, a transversely disposed strip of adhesive along a third part of the ply which is to form a flap and a fourth part extending from the third part. Thereafter, the two contiguous parts of the ply are folded onto each other and secured together via the adhesive strips to form an envelope with a pocket therebetween. Thereafter, information may be imaged on at least one side of the fourth part of the mailer while a customized address is printed on one side of the folded parts in an imaging means, for example, in a laser printer. This fourth part can be subsequently separated, folded and stuffed into the pocket of the envelope for mailing purposes. The flap may then be secured over the pocket and the thus closed envelope mailed.

The invention also provides a method of processing a one piece mailer form having an envelope portion including two parts which define an open pocket, a flap portion extending from one of the parts with an adhesive thereon and a further second portion which extends from the envelope portion. In accordance with the method, the mailer form is fed through an imaging means such as a laser printer to apply printed information on at least one side of the second portion and a customized address on the envelope portion. Thereafter, this second portion is separated from the envelope portion, folded and then inserted into the pocket of the envelope portion for mailing purposes. The flap on the envelope portion can then be folded to close the pocket.

These and other objects and advantages of the invention will become more apparent from the following description taken in conjunction with the accompanying drawings wherein.

Figure 1:
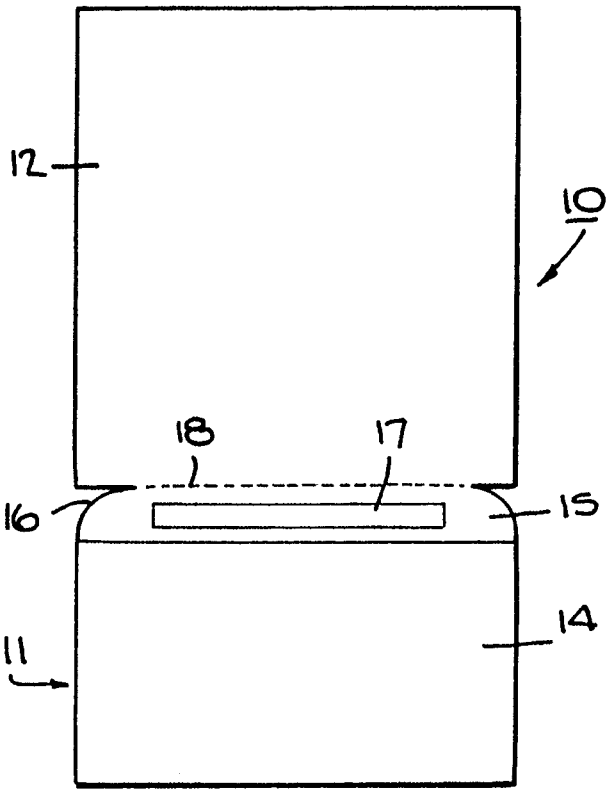
FIG. 1 illustrates a view of a one piece mailer constructed in accordance with the invention.

Referring to FIG. 1, the mailer form 10 is comprised of an envelope portion 11 and a letterhead portion 12 which are connected together to form an integrated unit.

The envelope portion 11 has a front part 13 (see FIG. 2) for receiving addressee information and a back part 14 (see FIG. 1) disposed over the front part 13 to define an open pocket therewith. In addition, a suitable adhesive (not shown) is used to secure the two parts 13, 14 to each other. For example, the glue may be applied as lines of glue along two opposite sides of the parts 13, 14 or where the two parts 13, 14 are made of separate plies, along three sides of the parts 13, 14.

The envelope portion 11 also has a flap part 15 extending from the front part 13 for folding over the back part 14 to close the pocket. As indicated, the flap part 15 may be provided with curved edges 16 which are formed by die cuts in the mailer form 13. The flap 15 is also provided with an adhesive 17 for securing the flap part 15 to the back part 14. In this respect, the adhesive 17 may be a heat resistant adhesive which is capable of being fed through a heat fusing stage of a laser printer or the like without detrimental effect to the adhesive or the printer. Such an adhesive may be as described in U.S. Pat. No. 4,951,864 and is capable of resisting heat up to and in excess of 400° F. while also providing lay flat characteristics.

The letterhead portion 12 extends from the flap part 15 of the envelope portion 11 and is sized to receive printed information thereon. A suitable line of weakening 18 is provided between the two portions 11, 12 to permit separation of the two portions 11, 12 from each other. As indicated in FIG. 2, one side or both sides of the letterhead portion may have a preprinted logo 19 thereon as well as conventional preprinted letterhead information.

The mailer form 10 is constructed of rectangular shape so that each portion 11, 12 has a width of 8.5 inches and an overall combined length of 11 inches. In this case, the back part 14 may have a length of 3.5 inches while the letterhead portion has a length of 6.875 inches. This particularly allows the letterhead portion 12 to be separated from the envelope portion 11, folded and then inserted into the pocket of the envelope portion 11. Other suitable dimensions are also possible such as for A-4 paper.

Figure 3:
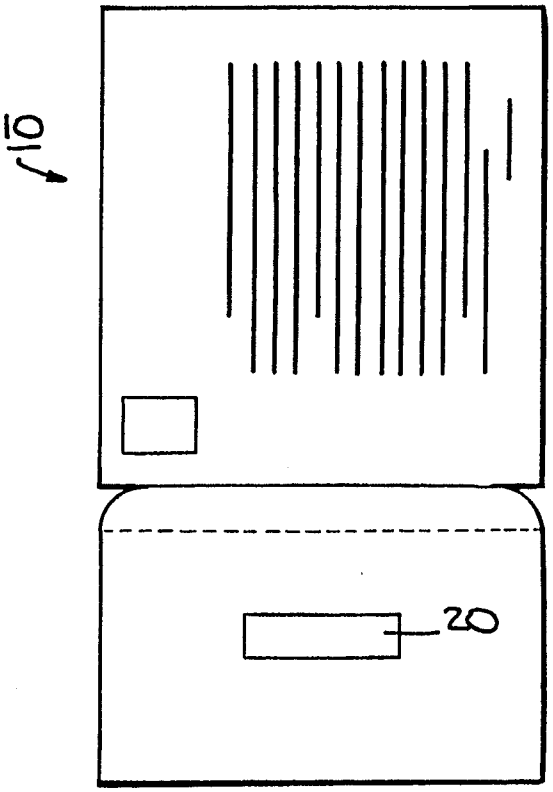
FIG. 3 illustrates a view of the mailer of FIG. 2 with information printed on a letterhead portion and a customized address on an envelope portion.

The mailer 10 is constructed on a composite form so as to be fed through a laser printer or like equipment. In this respect, the envelope form 10 is to be fed into the laser printer in a direction axially or transversely of the two portions 11, 12. In addition, a word processor connected to the laser printer may be suitably programmed by software so that the information is imaged on the letterhead portion 12 in a direction rotated 90° relative to the envelope portion. Such an arrangement is shown in FIG. 3. At the same time, addressee information 20 can be imaged within a predetermined block or area on the front part 13.

Figure 2:
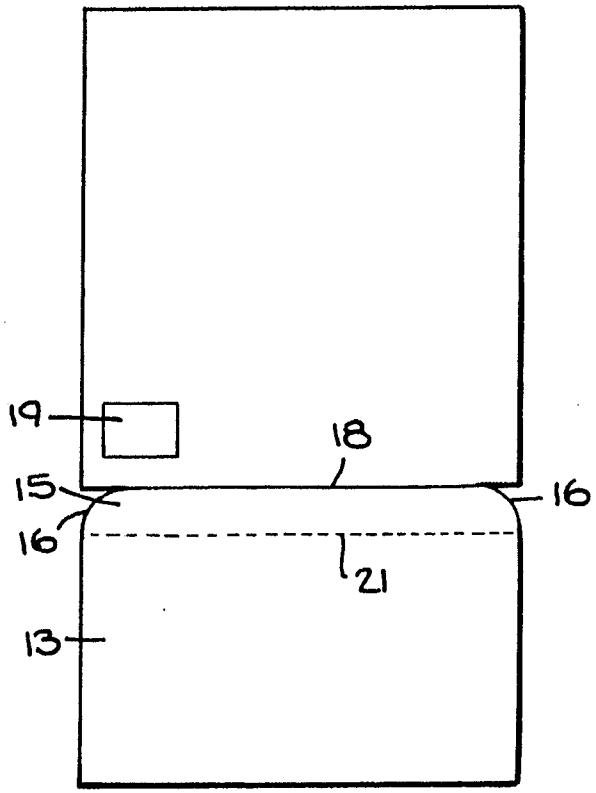
FIG. 2 illustrates a reverse view of the mailer of FIG. 1.

Referring to FIG. 2, the front part 13 is provided with a fold score or lines of weakening 21 along the flap part 15 in order to facilitate folding of the flap part 15 over the back part 14.

Figure 4:
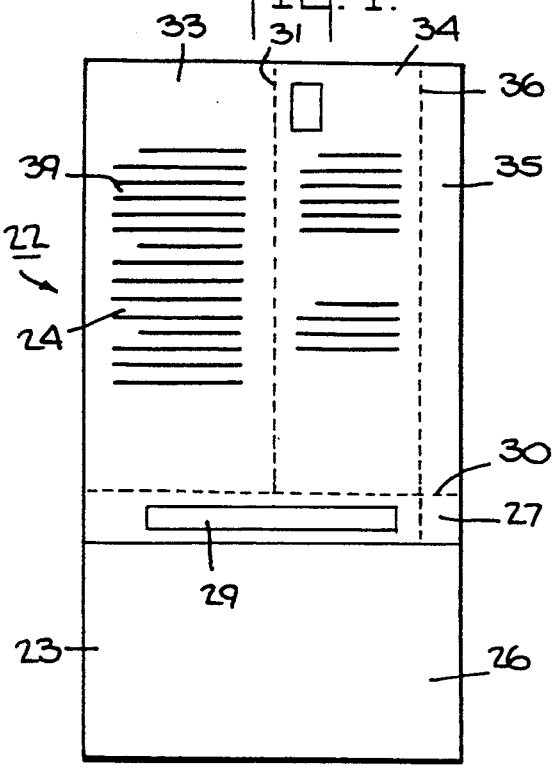
FIG. 4 illustrates a view of a modified mailer constructed in accordance with the invention.

Referring to FIG. 4, the one piece mailer form 22 may be constructed in an alternative fashion for different purposes. For example, the mailer form 22 includes an envelope portion 23 similar to that described above as well as an insert portion 24. In this embodiment, the envelope portion 23 has a front part 25 (see FIG. 5), a back part 26 disposed over the front part 25 to define a pocket, a flap part 27 which extends from the front part 25 and which is foldable along a fold line 28 (see FIG. 5) as well as a strip of adhesive 29 for securing the flap part 27 to the back part 26.

The insert portion 24 extends from the flap part 27 of the envelope portion 23 while a line of weakening 30 provides for separation of the two parts 23, 24 from each other. As shown, the insert portion 24 is of an equal width to the front and back parts 25, 26 of the envelope portion 23. In addition, the insert portion 24 has a fold score or line of weakening 31 extending perpendicular and intermediately of to the envelope portion 23, i.e. perpendicular to the line of weakening 30. As indicated, the fold line 31 separates two parts 33, 34 of the insert portion 24 from each other. In addition, a tear-off portion 35 extends from the flap part 27 in parallel to the insert portion 24 while a line of weakening 36 is provided between the tear-off portion 35 and the insert portion 24.

Figure 5:
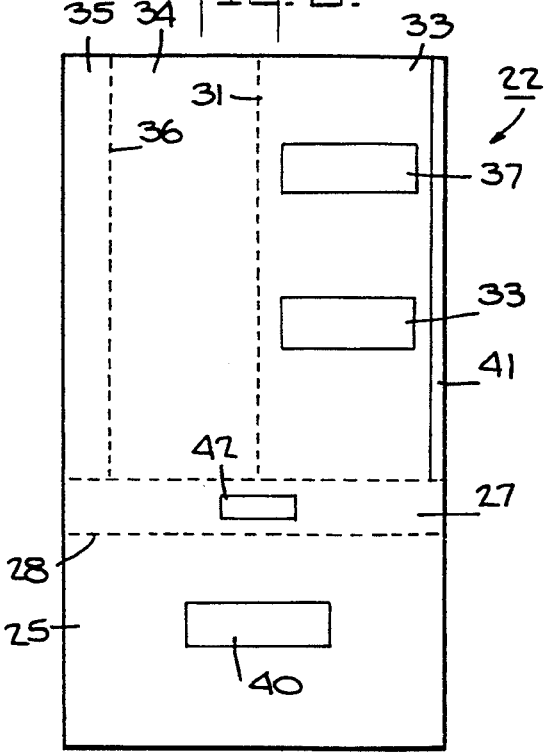
FIG. 5 illustrates a reverse view of the mailer of FIG. 4.

As illustrated in FIGS. 4 and 5, one part 33 of the insert portion 24 has preprinted information on the "front" surface (see FIG. 5), for example, this may include a "name" block 37 for receiving a name and an addressee block 38 for receiving the name of an addressee. For example, the name block 37 may be used to indicate that a gift is being made in the honor of some person while the addressee block 38 may indicate the donor. The adjacent part 34 of the insert may be blank. As indicated, one part 33 of the insert may be provided with a preprinted message 39 while the adjacent part 34 is provided with other printed information such as a greeting.

When the insert part 24 is separated from the envelope portion 23, the two parts 33, 34 can be folded about the line of weakening 31 so that the greeting appears on the front of the insert while the blank surface appears on the left inside and the name block 37 and addressee block 38 appear on the right inside of the insert. The folded insert may then be stuffed into the envelope portion 23. To this end, each part 33, 34 is of a length greater than the height of the pocket in the envelope portion 23 and a width less than the width of the pocket. Of note, the tear-off portion 35 is removed from the insert portion 24 at that time or before that time.

In use, the mailer blank 22 can be fed through an imaging means, such as a laser printer, so that customized information regarding an individual addressee can be placed within an address block 40 on the face of the front part 25 at the same time that the name of the addressee is printed in the addressee block 38. Another name may also be printed into the name block 37 of the insert portion 24. In this way, the mailer can be personalized for the recipient in one pass through the imaging means.

As indicated in FIG. 5, a section 41 of the "front" part 33 of the insert part 24 can be provided with a fanciful design or other aesthetically pleasing preprinted matter. For example, the design may be preprinted or imaged along one edge of the part 33. Further, as indicated in FIG. 5, the flap part 27 may be preprinted with a return address 42 of the sender.

As illustrated in FIGS. 4 and 5, the one piece mailer 22 may be of rectangular construction and sized to be fed through a laser printer. Further, the mailer 22 may be constructed so that the insert part 24 is of a laminated double ply construction so as to provide a greeting card-like feel and appearance to the insert part 24 when folded.

Further, the insert part 24 may be provided with additional fold lines perpendicular or parallel to the main fold line 31 or with additional lines of separation so that different sections of the insert part 24 can be separated by the recipient and used for various purpose, such as a business card. Still further, the insert part 24 may be provided with die-cut slots so as to receive a card such as a business card which can then be placed in the envelope portion for mailing. Further, each part of the insert part 24 may be colored with a color distinct from that of the remainder of the mailer.

Figure 6:
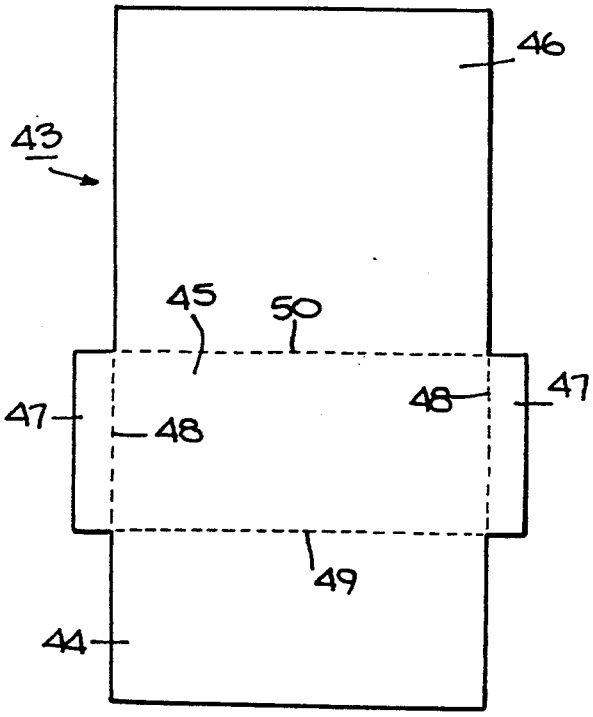
FIG. 6 illustrates a view of a further modified blank for constructing a mailer in accordance with the invention.

Referring to FIG. 6, a mailer 43 may be made of a one-piece blank which includes three parts 44, 45, 46 with the middle part 45 provided with a pair of tab portions 47, each of which extends from an opposite side of the middle part 45. Each tab portion 47 is sized so as to be folded via a fold line 48 onto the middle part 45. In addition, each tab portion 47, when folded, has a suitable adhesive (not shown) on a side facing the first part 44 so that the first part 44 can be folded about a transverse fold line 49 into contact with the tab portions 47 to thereby define a pocket between the two portions 44, 45.

The third part 46 of the mailer blank 43 is of similar construction to the letterhead portion 12 and insert portion 24 described above and is separate by a line of weakening 50 from the middle part 45.

Figure 7:
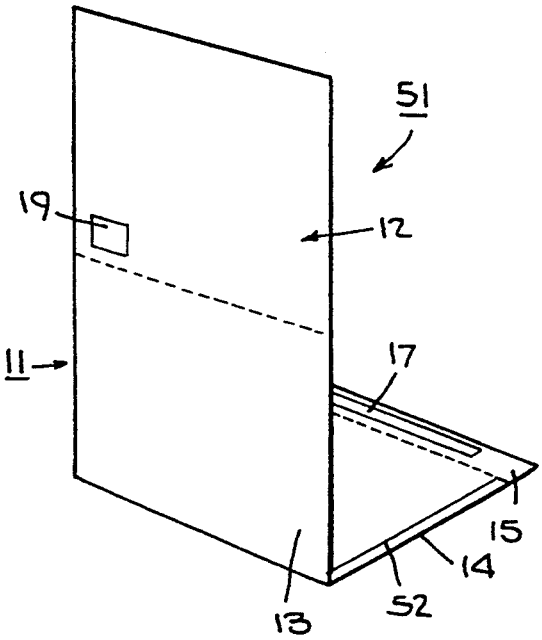
FIG. 7 illustrates a perspective view of a modified mailer constructed in accordance with the invention.

Referring to FIG. 7, wherein like reference characters indicate like parts as above, the envelope portion 11 of the mailer 51 may be constructed so that the flap portion 15 extends from the back part 14. In this construction, the insert part 12 extends directly from the front part 13 of the envelope portion 11. In this way, when the mailer 51 is fed through a hot fusing station of a printer, such as a laser printer, the adhesive 17 on the flap is protected, i.e. is not exposed. As indicated, a line of adhesive 52 is disposed on each of at least two opposite edges of the front part 14 to secure the parts 13, 14 together.

In order to make a mailer, for example as described in FIGS. 1 and 2, a single ply of paper is obtained having a pair of adhesive strips (not shown) along opposite sides of at least one part of two contiguous parts 13, 14 of the ply. In addition, the single ply of paper has a transversely disposed strip of adhesive 17 along a third part 15 of the ply as well as a fourth part 12 extending from the third part 15.

Thereafter, two parts 13, 14 of the ply of paper are folded onto each other and secured so as to form an envelope portion with an open pocket. The resultant form can then be imaged on at least one side of the fourth part 12 as well as addressed on one part of the envelope portion 13, 14, for example, in a laser printer.

After imaging, the fourth part 12 can be separated from the third part 15, folded and then stuffed into the pocket of the envelope portion.

The method of processing the mailer form 10, such as described in FIGS. 1 and 2, includes feeding the mailer form 10, for example, in a direction axially of the portions 11, 12, i.e. perpendicular to the line of weakening 18, through a laser printer (not shown) to apply printed information on at least one side of the letterhead portion 12 as well as addressee information 20 on the envelope portion (see FIG. 3). Thereafter, the letterhead portion 12 is separated from the envelope portion 11, folded and then inserted into the pocket of the envelope portion 11 for mailing purposes. At this time, the adhesive 17 on the flap portion 15 can be activated and the flap portion 15 folded over onto the back part 14 to seal the envelope.

During passage through the laser printer, addressee information is applied in the addressee block 20 of the envelope portion 11 while other information can be printed on the letterhead portion 12, for example, in a direction rotated 90° from the direction of feed through the laser printer. This can be accomplished through suitable programming of the software of a word processor, for example, via use of a template or macro, used to feed the printer with information to be graphically imaged.

The invention thus provides an integrated mailer form which can be preprinted in large quantities with a common message or theme or blank and graphics imager. Thereafter, each mailer can be individually personalized by being passed through an imaging means such as a laser printer prior to separation of the insert part and stuffing of the separated insert part into the envelope portion for mailing purposes.

The invention provides a composite mailer form having an integrated envelope portion and letterhead or insert portion which can both be imaged in one pass through an imaging means such as a laser printer. This eliminates a need for a separate typewriter or the like to image addressee information on the envelope portion. The invention also eliminates the risk of stuffing the wrong personalized letter into the wrong envelope.

The invention particularly provides a one piece mailer which can be utilized for forming and transmitting greeting cards and the like in a relatively simple, efficient manner.

The invention further provides a one piece mailer which can be provided with preprinted information and subsequently personalized so as to provide a greeting card effect.

What is claimed is:

1. An integrated mailer form of rectangular shape comprising an envelope portion having a front part for receiving addressee information thereon, a back part disposed over said front part to define an open pocket therewith, an adhesive securing said parts to each other, a flap part extending from said front part for folding over said back part to close said pocket and an adhesive on said flap part for securing said flap part to said back part;

an insert portion extending from said flap part of said envelope portion, said insert portion having a line of weakening extending perpendicular to said envelope portion to define a tear-off portion and a fold line extending perpendicular to said envelope portion to define two parts extending from said flap portion for selectively receiving printed information, each of said two parts being of a length parallel to said fold line greater than said height of said pocket and sized to permit folding about said fold line and stuffing of said two parts into said pocket after removal of said tear-off portion therefrom; and a line of weakening between said portions to permit removal of said insert portion from said envelope portion and subsequent folding of said two parts of said insert portion about said fold line for insertion in said pocket.

2. A mailer form as set forth in claim 1 wherein each said portion has a width of 8.5 inches.

3. A mailer form as set forth in claim 2 wherein said portions have a combined length of 11 inches.

4. A mailer form as set forth in claim 2 wherein said back part has a length of 3.5 inches and said letterhead portion has a length of 6.875 inches.

5. A mailer form as set forth in claim 1 wherein one side of said letterhead portion has a preprinted logo thereon.

6. A mailer form as set forth in claim 1 wherein at least one part of said insert portion has pre-printed information thereon.

7. A mailer form as set forth in claim 1 wherein said insert portion is of laminated double ply construction.

8. A mailer form as set forth in claim 1 wherein on of said parts of said insert portion has an addressee block on one side for receiving the name of an addressee and said envelope portion has an address block on said front part for receiving the name of said addressee to personalize the mailer.

9. A mailer form as set forth in claim 8 wherein said side of said one part of said insert portion has a second block for receiving a printed name.

10. A mailer form as set forth in claim 8 wherein said insert portion has preprinted information on at least one of said parts on a side opposite said one side.

11. A mailer form as set forth in claim 8 wherein said flap portion has a preprinted return address thereon.

12. A mailer form as set forth in claim 8 wherein said insert portion is of laminated double ply construction to

13. An integrated mailer form comprising an envelope portion having a front part for receiving addressee information thereon, a back part having a free edge and being disposed over said front part to define an open pocket of predetermined height therewith, said front part and said back part being substantially coextensive in length and width, an adhesive securing said parts to each other, a flap part extending from said front part for folding over said back part to close said pocket and an adhesive on said flap part for securing said flap part to said back part;

an insert portion having a fold line extending perpendicular to and intermediately of said envelope portion to define two parts for selectively receiving printed information, each of said two parts being of a length parallel to said fold line greater than said height of said pocket and a width less than the width of said pocket to permit folding about said fold line and stuffing of said two parts into said pocket; and a line of weakening between said portions to permit separation of said insert portion from said envelope portion and subsequent folding of said two parts of said insert portion about said fold line for insertion in said pocket of said envelope portion. provide a greeting card-like feel and appearance thereto when folded.

14. An integrated mailer form as set forth in claim 13 wherein said envelope portion is of rectangular shape.

15. An integrated mailer form as set forth in claim 13 wherein said insert portion extends directly from said flap part of said envelope portion.

16. An integrated mailer form as set forth in claim 13 wherein said insert portion has a line of weakening extending perpendicular to said envelope portion to define a tear-off portion.

17. An integrated mailer form as set forth in claim 13 wherein said insert portion is of laminated double ply construction to provide a greeting card-like feel and appearance to said insert portion when folded about said fold line.

18. An integrated mailer form as set forth in claim 17 wherein one of said parts of said insert portion has a printed greeting on one side thereof and the other of said parts of said insert portion has a printed message on one side thereof.

19. A one piece mailer form of rectangular shape comprising an envelope portion having a front part for receiving addressee information thereon, a back part having a free edge and being disposed over said front part to define an open pocket therewith, said front part and said back part being substantially coextensive in length and width, an adhesive securing said parts to each other, a flap part extending from said front part for folding over said back part to close said pocket and an adhesive on said flap part for securing said flap part to said back part;

an insert portion extending from said flap part of said envelope portion, said insert portion having a fold line extending perpendicular to and intermediately of said envelope portion to define two unperforated parts for selectively receiving printed information, each said part having a length parallel to said fold line greater than the height of said pocket; and a line of weakening between said envelope portion and said insert portion to permit separation of said insert portion from said envelope portion and subsequent folding of said two parts of said insert portion about said fold line for insertion in said pocket of said envelope portion.

20. A mailer form a set forth in claim 19 wherein said insert portion has a line of weakening extending perpendicular to and intermediately of said envelope portion to define a tear-off portion.

21. A mailer form as set forth in claim 19 wherein said insert portion is of laminated double ply construction to provide a greeting card-like feel and appearance to said insert portion when folded about said fold line.

22. A mailer from as set forth in claim 21 wherein one of said parts of said insert portion has a printed greeting on one side thereof and the other part of said insert portion has a printed message on one side thereof.

* * * * *

UNITED STATES PATENT AND TRADEMARK OFFICE

CERTIFICATE OF CORRECTION

PATENT NO. : 5,377,904

DATED : January 3, 1995

INVENTOR(S) : Irving R. Michlin, et al

It is certified that error appears in the above-indentified patent and that said Letters Patent is hereby corrected as shown below:

Column 2, line 6 change "all" to -an-
Line 54 change "meads" to -means-

Column 4, line 53 change "on" to -as-

Column 5, line 19 after "perpendicular" insert -to-; cancel "to"

Column 6, line 33 change "separate" to -separated-

Column 8, line 22 change "on" to -one-
Line 37 after "construction to" insert -provide a greeting card-like feel and appearance thereto when folded.-

Lines 64 to 66 cancel "provide a greeting card ... folded."

Signed and Sealed this

Fourth Day of April, 1995

*Attest:*

Bruce Lehman

BRUCE LEHMAN

*Attesting Officer*

*Commissioner of Patents and Trademarks*